US005720149A

United States Patent [19]

Stimpfl

[11] Patent Number: 5,720,149

[45] Date of Patent: Feb. 24, 1998

[54] APPARATUS FOR THE PACKAGING OF ARTICLES

[75] Inventor: Christof Stimpfl, Vogt, Germany

[73] Assignee: Stimpfl & Gieseler GmbH, Germany

[21] Appl. No.: 624,445

[22] PCT Filed: Sep. 19, 1994

[86] PCT No.: PCT/EP94/03134

§ 371 Date: Apr. 3, 1996

§ 102(e) Date: Apr. 3, 1996

[87] PCT Pub. No.: WO95/09768

PCT Pub. Date: Apr. 13, 1995

[30] Foreign Application Priority Data

Oct. 4, 1993 [DE] Germany ..... 43 33 784.8
Oct. 7, 1993 [DE] Germany ..... 43 34 238.8

[51] Int. Cl.[6] ..... B65B 5/10

[52] U.S. Cl. ..... 53/244; 53/148; 53/236; 53/246; 53/251

[58] Field of Search ..... 198/611, 612, 198/614, 812; 53/148, 236, 244, 245, 246, 247, 248, 251

[56] References Cited

U.S. PATENT DOCUMENTS

| | | | |
|---|---|---|---|
| 3,067,558 | 12/1962 | Good | 53/247 X |
| 3,460,667 | 8/1969 | Lanham | 198/812 X |
| 3,488,917 | 1/1970 | Oswald et al. | 53/245 |
| 3,759,126 | 9/1973 | Burgess | 198/812 X |
| 4,031,999 | 6/1977 | Wagner et al. | 198/442 X |
| 4,733,518 | 3/1988 | Griesdorn | 53/148 X |
| 5,099,634 | 3/1992 | Treloar | 53/244 X |
| 5,388,385 | 2/1995 | Phelps et al. | 53/247 |
| 5,502,949 | 4/1996 | Main et al. | 53/245 X |

FOREIGN PATENT DOCUMENTS

| | | |
|---|---|---|
| 2277750 | 2/1976 | Germany . |
| 2516583 | 10/1976 | Germany . |

*Primary Examiner*—Daniel Moon
*Attorney, Agent, or Firm*—Bachman & LaPointe, P.C.

[57] ABSTRACT

In an apparatus for the packaging of articles, in particular of sausages (1) or of raw sausage meat (50) formed into sausages (1*a*) which arrive at a packaging station (3) via a feed device (2), at least one trough wheel (22) is to be arranged in the packaging station (3) above a packing means (36) and to be associated with the feed device (2), wherein the trough wheel (22) and packing means (36) are movable relative to each other.

12 Claims, 3 Drawing Sheets

APPARATUS FOR THE PACKAGING OF ARTICLES

BACKGROUND OF THE INVENTION

The present invention relates to an apparatus for the packaging of articles, in particular of sausages or of raw sausage meat formed into sausages, which arrive at a packaging station via a feed device.

From German Unexamined Application for Patent 42 18 783, there is known, for instance, an apparatus for the separating of sausages from a sausage strand. After the separation, these sausages arrive unsorted at a packaging station and must be expensively inserted there by hand into corresponding packing means and packaged.

An improvement in this device is offered by Patent 43 18 301, in which the sausages are sorted by size after the separation and filled into corresponding containers.

SUMMARY OF THE INVENTION

The present invention relates to a further improvement in the last-mentioned invention. In particular, the sausages are to be introduced individually and automatically into a packing means.

This objective is achieved in the manner that in the packaging station and above a packing means, there is arranged at least one trough wheel associated with the feed device, the trough wheel and packing means being movable relative to each other.

Only one trough wheel is provided in a first embodiment. Said trough wheel effects a separating of the individual articles, the present invention relating in particular to sausages. In this way, sausages can be packaged both in synthetic and natural casing. The apparatus can, however, also be used for salami or, for instance, for so-called "beer balls". All that is required in each case is to correspondingly develop the trough wheel and the packing means.

For the sake of simplicity, the trough wheel is located between two side plates, a corresponding rotating shaft for the trough wheel being rotatably mounted in the side plates. A corresponding drive can, in that case, also be associated from the start with said shaft.

In order to make it possible to fill the packing means continuously, the trough wheel is moved over the packing means or, in the case of another embodiment of the invention, the packing means is pulled away below the trough wheel upon its rotation. Both embodiments must be considered equivalent.

When the trough wheel is moved, the side plates are preferably arranged slidably on linear guides. They form, together with the trough wheel, a kind of carriage which can be moved back and forth on the linear guides.

This last-mentioned movement is effected by another drive which is connected, for instance, to a ball screw drive. Said ball screw drive passes through a corresponding tapped hole in a driving block which in turn is connected to a side plate.

As mentioned above, the apparatus of the present invention is to make it possible to package all kinds and shapes of sausages. It is advisable, in this case, for the trough wheel to be connected in readily replaceable manner to the side plates, since different sausages also require different troughs. The packing means should also be developed accordingly. If the packing means consist, for instance, of a deep-drawn sheet, the corresponding mold for said sheet can already be integrated in the packaging station. In that case, it also forms the trough for receiving the sausages and is arranged below the trough wheel. The mold has in that case a development which corresponds to the development of the trough wheel, i.e. the apex width between two troughs of the trough wheel corresponds approximately to the width of a web between two troughs of the mold.

Inasmuch as the entire apparatus is to operate continuously, it is advisable to provide in addition to the one packing means also at least one second packing means which, after the filling of the first packing means, is transferred to below the trough wheel. In this case, the packing means itself or the corresponding mold can be pushed below the trough wheel or else the trough wheel can be moved above the second packing means via corresponding guide rails.

In the event that the trough wheel is movable relative to the packing means, it also appears essential for the conveying device to be so developed that it can follow the trough wheel. This is achieved by a conveyor belt, the length of which can be changed as a function of the movement of the trough wheel. For this purpose, a forward guide roller for the conveyor belt is rotatably mounted with a shaft between the two side plates. The conveyor belt furthermore wraps around a rear guide roller, the shaft of which is in turn connected to a drive. Between the two guide rollers, the conveyor belt however forms a loop which is tensioned by a weight. This loop forms a reserve for the conveyor belt to the extent that the conveyor belt follows the trough wheel.

For the sake of simplicity, the weight is guided in a frame and the frame is arranged close to the packaging station.

In accordance with the invention, it is provided that the corresponding drives for the trough wheel and the conveyor belt consist of servomotors.

In another embodiment of the invention, the feed device consists of a hopper for raw sausage meat in the outlet of which there are provided two trough wheels on corresponding shafts which rotate in opposite direction. The above-mentioned troughs of the trough wheels together form, in each case, a mold space in which the sausage is formed from the raw sausage meat. Upon the further rotation, the sausage is released downward and can drop onto the packing means. In this manner, skinless sausages are produced and packaged.

It goes without saying that also in the case of this embodiment, the position of the troughs or of the mold space must be adapted to each other. This can be accomplished, for instance, by a corresponding regulation of the speed of rotation of the trough wheels.

BRIEF DESCRIPTION OF THE DRAWINGS

Further advantages, features and details of the invention result from the following description of preferred embodiments and from the drawing; the latter shows in FIG. 1 a side view of an apparatus according to the invention for the packaging of articles.

DETAILED DESCRIPTION OF PREFERRED EMBODIMENTS

Figure 1:
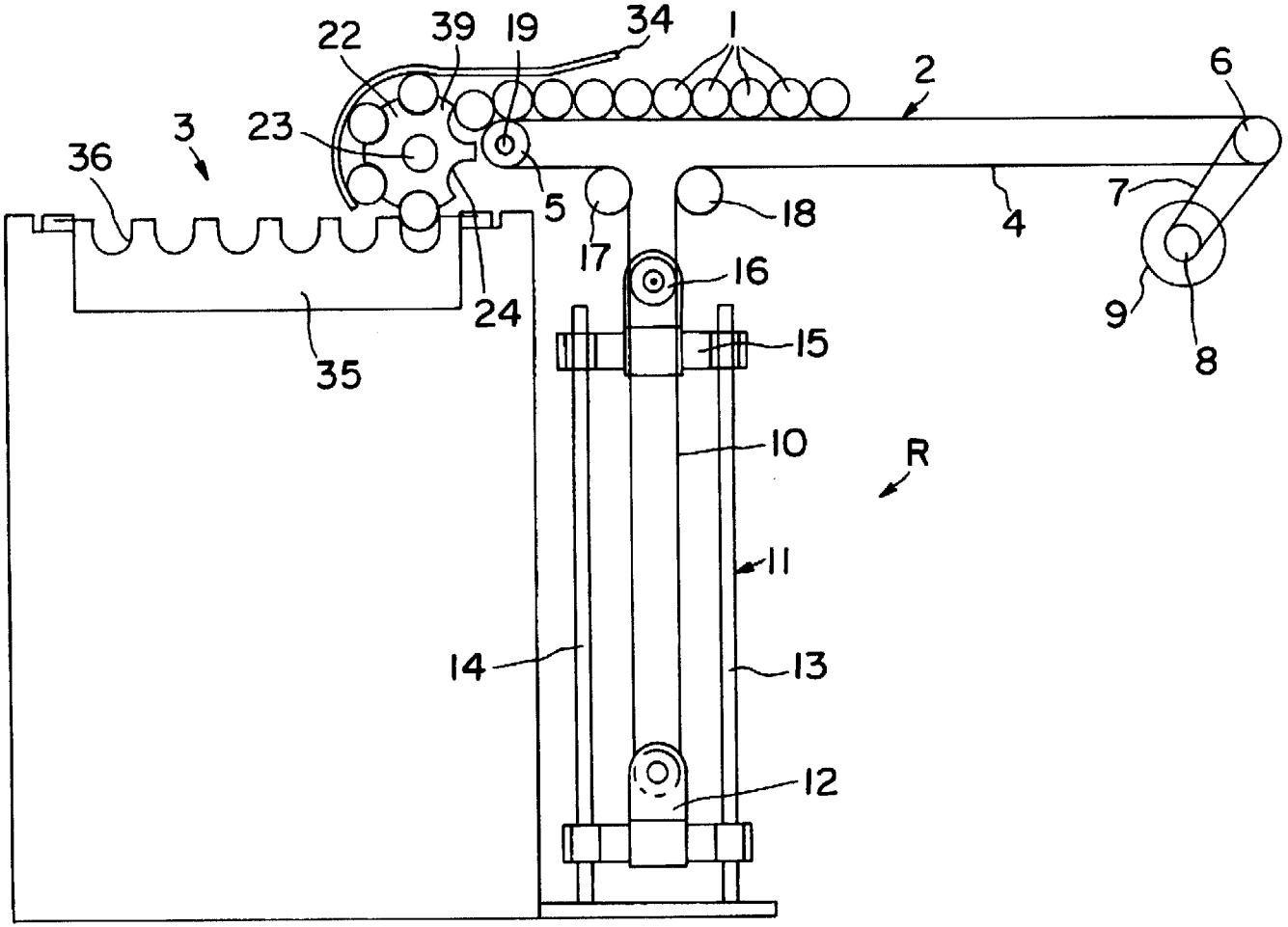

An apparatus R according to the invention for the packaging of articles, in particular of sausages 1, has according to FIG. 1 a feed device 2 and a packaging station 3. The feed device 2 has a flexible conveyor belt 4 which wraps around a forward guide roller 5 and a rear guide roller 6, the rear guide roller 6 being coupled via a drive belt 7 to a drive wheel 8 of a motor 9.

Between the forward guide roller 5 and the rear guide roller 6 the conveyor belt 4 forms a loop 10 which, within a frame 11, wraps around a weight 12 which is vertically displaceable. The weight 12 is guided on two vertical rods 13 and 14. The vertical rods 13 and 14 are mounted in their upper region on a mounting 15 with which a spacing roller 16 is associated which serves to better guide the loop 10. After the spacing roller 16, the conveyor belt 4 is wrapped around two additional guide rollers 17 and 18.

Figure 2:
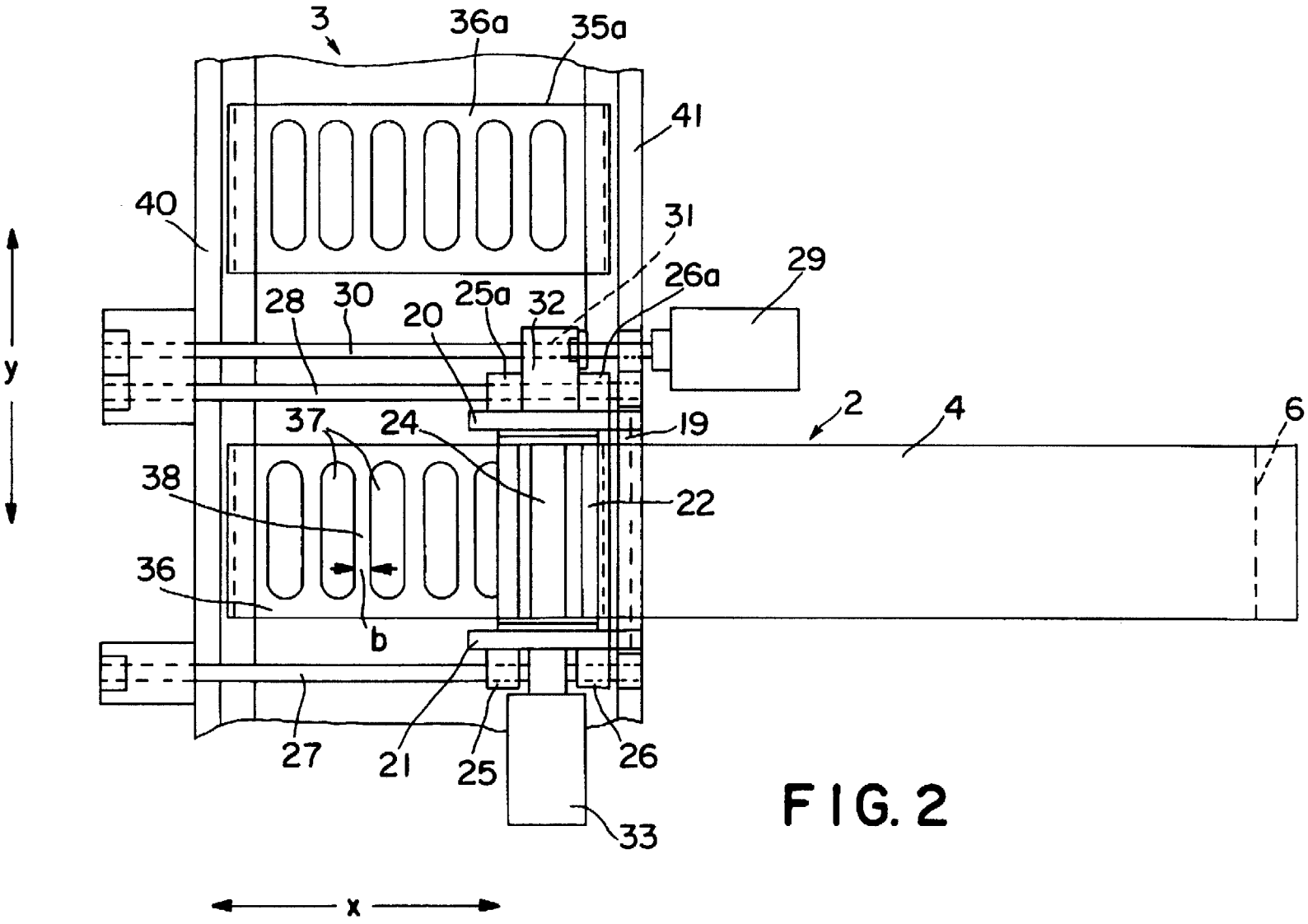
FIG. 2 a top view of the apparatus of FIG. 1.

The shaft 19 (see FIG. 2) of the forward guide roller 5 is rotatably mounted in two side plates 20 and 21. The side plates 20 and 21 also receive between them a trough wheel 22 which rotates around an axis 23. Troughs 24 for receiving the sausages 1 are formed in the circumference of the trough wheel 22.

Two bearing sleeves 25 and 26 or 25*a* and 26*a* respectively are in each case formed on the side plates 20 and 21, the boreholes of said bearing sleeves being passed through by linear guides 27 and 28. In this way, the trough wheel 22, together with the side plates 20 and 21 can be moved in the manner of a carriage in the direction of the double arrow x. This movement is effected by a translational drive 29 which can, for instance, be a servomotor. The drive 29 is connected to a ball screw drive 30 which passes through a corresponding tapped hole 31 in a driving block 32 attached to the side plate 20.

A rotational drive 33 which is fixed in position on the side plate 21 serves to drive the trough wheel 22. Upon movement of the trough wheel 22 in the direction x, the drive 33 is carried along. The drive 33 is also preferably developed as servomotor.

The trough wheel 22 is furthermore developed in readily replaceable manner so that differences between sausages can be taken into account by different troughs 24. Furthermore, shears are provided on both sides of the trough wheel 22 by means of which sausage strips which are still present can for instance be cut off.

FIG. 1 furthermore shows that a guide plate 34 serves to better guide the sausages 1 towards the trough wheel 22.

Below the trough wheel 22, a mold 35 is arranged in the packaging station 3 which serves for the deep-drawing of a sheet 36 which is merely indicated. The mold 35 or sheet 36 forms a trough 37 for receiving the sausages 1. In this connection, the width b of a web 38 corresponds to an apex width of webs 39 between two troughs 24 of the trough wheel 22. In this way, assurance is had that the sausages 1 pass from the troughs 24 properly into the troughs 37.

The entire arrangement consisting of ball screw drive 30, drive 29, trough wheel 22 and drive 33, as well as the linear guides 27 and 28 and the feed device 2 are preferably arranged on guide rails 40 and 41 along which they can be moved in the direction of the double arrow y. In this way, it is possible to fill a second mold 35*a* with a corresponding sheet 36*a* upon return travel of the trough wheel 22 while the filled sheet 36 is being removed from the mold 35 and provided with a corresponding cover sheet.

The manner of operation of the present invention is as follows:

As soon as sausages 1 on the conveyor belt 4 arrive at the trough wheel 22, the trough wheel 22 starts to rotate. Corresponding sensors and controls effect the starting of the drive 29 when the first trough 24 has arrived above the first trough 37 of the mold 35. Thereupon, the trough wheel 22 rotates in such a manner that the sausages 1 pass in orderly manner into the molds 35.

Upon movement of the trough wheel 22 in the direction x, the conveyor belt 4 follows it, the loop 10 being partially reduced or increased again under the weight 12.

As soon as a sheet 36 has been filled, the entire arrangement is moved over the mold 35*a* or else the mold 35*a* is moved below the trough wheel 22. In order to fill the mold 35*a*, the trough wheel 22 then travels back again into its starting position. The entire arrangement operates smoothly and very rapidly.

Figure 3:
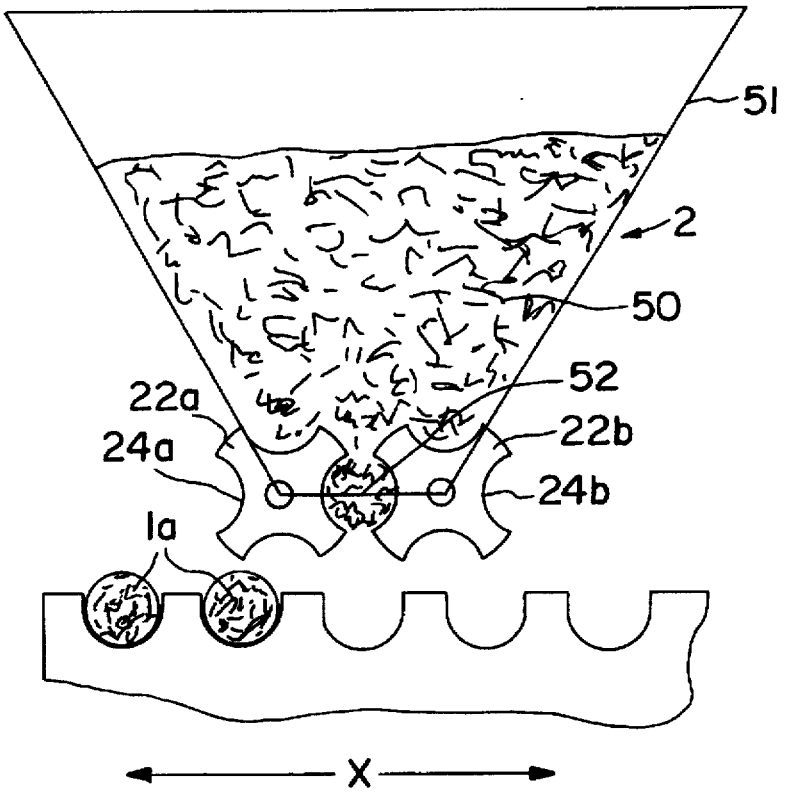
FIG. 3 a side view of a cutaway portion of an apparatus according to the invention for the packaging of raw sausage meat which has been formed into a sausage.
Figure 4:
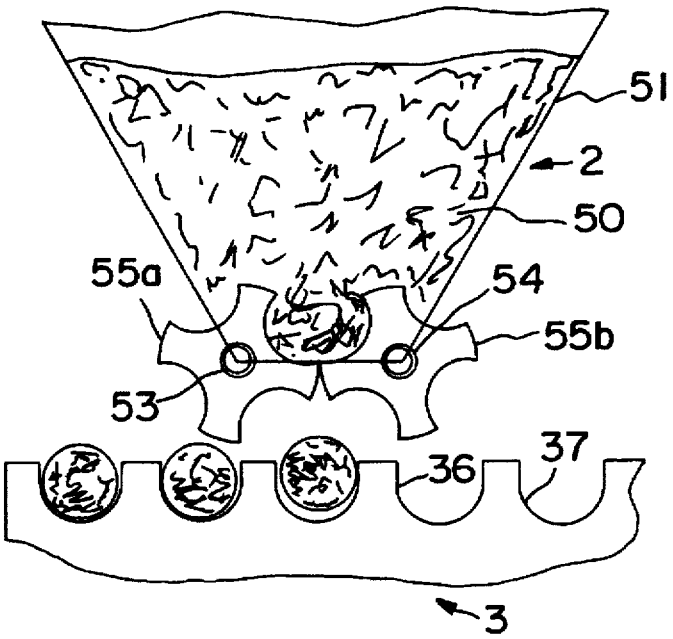
FIG. 4 a side view of the apparatus of FIG. 3 in another position of use.

FIGS. 3 and 4 show an apparatus for the packaging of raw sausage meat 50 which has been formed into a sausage 1*a*. The raw sausage meat 50 is present in a hopper 51, two trough wheels 22*a* and 22*b* being associated with a hopper outlet 52. In this case, the hopper 51 constitutes the feed device 2.

Both trough wheels 22*a* and 22*b* rotate in opposite direction around a shaft 53 and 54 respectively. They are so arranged in this connection that their troughs 24*a* and 24*b* and their apices 55*a* and 55*b* are always opposite each other. In this way, a part of the sausage meat 50 is actively received and surrounded in and between two troughs 24*a* and 24*b* and formed into a sausage 1*a*. This is shown in FIG. 3.

Upon the further rotating of the trough wheels 22*a* and 22*b*, the sausage formed in this manner is released in downward direction as shown in FIG. 4 and drops into a trough 37 of the packaging station 3 or onto the sheet 36. The latter can then be closed off with a cover sheet.

In this way, successive troughs 37 can be filled, the hopper moving together with the trough wheels 22*a* and 22*b* over the troughs in the direction x. The position of the troughs 37 is adapted to the speed of the trough wheels 22*a* and 22*b*.

I claim:

1. An apparatus for the packing of sausages which arrive at a packaging station via a feed device, which comprises: a packaging station including packing means; at least one movable trough wheel above said packaging station and having sausage receiving openings therein; a feed device associated with said trough wheel; wherein the trough wheel is movable over the packing means; and a conveyor belt of said feed device for feeding the sausages to the respective sausage receiving openings of said trough wheel and adjoining the trough wheel; and wherein the length of the conveyor belt is variable depending upon the movement of the trough wheel over the packing means.

2. An apparatus according to claim 1, wherein at least a second packing means is provided in the packaging station in addition to the packing means, and wherein said second packing means is operable to be moved below said trough wheel.

3. An apparatus according to claim 1, wherein said trough wheel is replaceable and has troughs for receiving the sausages.

4. An apparatus according to claim 1, wherein said trough wheel is rotatably mounted between two side plates, and including a shaft of said trough wheel connected to a drive.

5. An apparatus according to claim 4, wherein said drive is a servomotor.

6. An apparatus according to claim 4, wherein said side plates are arranged slidable on linear guides.

7. An apparatus according to claim 6, including a translational drive for the driving of the trough wheel together with the side plates.

8. An apparatus according to claim 7, including a ball screw drive connected to said drive, said ball screw drive passing through a corresponding tapped hole in a driving block on said side plate.

9. An apparatus according to claim 4, including a forward guide roller for the conveyor belt seated with a shaft between said two side plates.

10. An apparatus according to claim 9, wherein said conveyor belt wraps around a rear guide roller, the shaft of which is connected to a drive.

11. An apparatus according to claim 10, wherein the conveyor belt forms, between the two guide rollers, a loop which is tensioned by a weight.

12. An apparatus according to claim 11, wherein said weight is guided in a frame.

* * * * *